US008783830B2

(12) United States Patent
Kanemoto et al.

(10) Patent No.: US 8,783,830 B2
(45) Date of Patent: Jul. 22, 2014

(54) DROPLET EJECTING DEVICE AND PRINTING DEVICE

(75) Inventors: Shuichi Kanemoto, Nagano (JP); Toshihiro Yokozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 13/433,872

(22) Filed: Mar. 29, 2012

(65) Prior Publication Data

US 2012/0249683 A1 Oct. 4, 2012

(30) Foreign Application Priority Data

Mar. 30, 2011 (JP) ..... 2011-075812

(51) Int. Cl.
*B41J 2/04* (2006.01)
*B41J 2/17* (2006.01)

(52) U.S. Cl.
USPC ..... 347/54; 347/84

(58) Field of Classification Search
None
See application file for complete search history.

(56) References Cited

U.S. PATENT DOCUMENTS

| | | | | |
|---|---|---|---|---|
| 7,147,298 | B2 * | 12/2006 | Usuda | 347/35 |
| 7,195,335 | B2 * | 3/2007 | Usui | 347/30 |
| 2003/0122905 | A1 | 7/2003 | Suzuki et al. | |
| 2010/0171796 | A1 * | 7/2010 | Hiramoto | 347/68 |

FOREIGN PATENT DOCUMENTS

| | | | |
|---|---|---|---|
| JP | 2003-251822 | A | 9/2003 |
| JP | 2011-126113 | A | 6/2011 |
| JP | 2011-126114 | A | 6/2011 |

* cited by examiner

*Primary Examiner* — Stephen Meier
*Assistant Examiner* — Renee I Wilson
(74) *Attorney, Agent, or Firm* — Global IP Counselors, LLP

(57) ABSTRACT

A droplet ejecting device includes an ejection head, a moving body, a guide part, an attachment part, a fixed part and a liquid reservoir. The ejection head is configured and arranged to eject liquid droplets onto a substrate. The moving body supports the ejection head, and is configured and arranged to move integrally with the ejection head with respect to the substrate. The guide part is configured and arranged to guide a relative movement of the moving body. The attachment part is attached to the guide part and supporting the moving body, and configured and arranged to move integrally with the moving body. The fixed part is fixed to the attachment part separately from the moving body. The liquid reservoir is provided to the fixed part, and configured and arranged to store the liquid supplied to the ejection head.

20 Claims, 8 Drawing Sheets

DROPLET EJECTING DEVICE AND PRINTING DEVICE

CROSS-REFERENCE TO RELATED APPLICATIONS

This application claims priority to Japanese Patent Application No. 2011-075812 filed on Mar. 30, 2011. The entire disclosure of Japanese Patent Application No. 2011-075812 is hereby incorporated herein by reference.

BACKGROUND

1. Technical Field

The present invention relates to a droplet ejecting device and a printing device.

2. Related Art

In recent years, droplet ejecting devices that form an image or pattern on a recording medium using UV-curable ink, which cures upon irradiation with ultraviolet light, have been receiving attention. UV-curable ink, which dries extremely slowly until irradiated with ultraviolet light, at which point it rapidly cures, has properties favorable for use as printer inks. Because no solvent is evaporated when it cures, this type of ink also has the advantage of placing little burden upon on the environment.

UV-curable ink also demonstrates high bondability to a variety of recording media depending on vehicle composition. It also possesses many superior properties, such as chemical stability after curing, adhesiveness, chemical resistance, weather resistance, friction resistance, and the ability to withstand outdoor environments. For this reason, apart from thin, sheet-like recording media such as paper, resin film, metal foil, and the like, UV-curable ink can also form images on materials with surfaces having some degree of three-dimensionality, such as recording media labels, textile products, and the like.

In droplet ejecting devices of this sort, a configuration is utilized wherein ink stored in a liquid reservoir, such as, for example, an ink pack or an ink cartridge, is guided to a pressure chamber in a recording head, a pressure fluctuation is generated in the ink within the pressure chamber by a pressure source such as a piezoelectric vibrator driven by a drive signal applied thereto, and ink is ejected from a nozzle by controlling the pressure fluctuation. The recording head is mounted on a moving body called a carriage, and ejects ink while traveling in relation to the recording medium. Japanese Laid-Open Patent Application Publication No. 2003-251822 describes a technique in which an ink tank is mounted on a carriage as a liquid reservoir.

SUMMARY

However, the following problems are present in the above described prior art.

Because the liquid reservoir is supported by the carriage on which the recording head is mounted, the load placed on the carriage is great, and there is the possibility of the mobility properties thereof being negatively affected. In such a case, there is the possibility of ink ejection accuracy, and by extension printing accuracy, being negatively affected.

The present invention was contrived in light of the circumstances described above, and has as an object thereof the provision of a droplet ejecting device and a printing device capable of minimizing reductions in liquid ejection accuracy.

In order to achieve the above object, the present invention has the following configuration.

A droplet ejecting device according to one aspect of the present invention includes an ejection head, a moving body, a guide part, an attachment part, a fixed part and a liquid reservoir. The ejection head is configured and arranged to eject liquid droplets onto a substrate. The moving body supports the ejection head, and is configured and arranged to move integrally with the ejection head with respect to the substrate. The guide part is configured and arranged to guide a relative movement of the moving body. The attachment part is attached to the guide part and supporting the moving body, and configured and arranged to move integrally with the moving body. The fixed part is fixed to the attachment part separately from the moving body. The liquid reservoir is provided to the fixed part, and configured and arranged to store the liquid supplied to the ejection head.

Thus, because the liquid reservoir is attached to the attachment part via the fixed part separately from the moving body supporting the ejection head in the droplet ejecting device according to the above described aspect of the present invention, it is possible to prevent the load placed on the moving body from increasing. For this reason, the present invention enables the minimization of adverse effects upon the mobility of the moving body and of reductions in ejection accuracy.

The droplet ejection device according to the above described aspect preferably further includes a stirring device provided on the fixed part, and configured and arranged to move and stir the liquid reservoir.

Thus, the above described aspect of the present invention makes it possible to prevent the liquid in the liquid reservoir from settling, leading to adverse effects on ejection properties; and to lessen the distance between the stirring device and the liquid reservoir, making it possible to easily move and stir the liquid reservoir.

In the droplet ejection device according to the above described aspect, the stirring device preferably includes a rotating drive device configured and arranged to rotate the liquid reservoir around an axis extending in a horizontal direction.

Thus, the liquid within the liquid reservoir the present invention is made to move in the vertical direction, enabling effective agitation thereof.

In the droplet ejection device according to the above described aspect, the liquid reservoir is preferably disposed on an opposite side relative to the moving body in a predetermined direction with the guide part being disposed between the liquid reservoir and the moving body in the predetermined direction.

Through this, it is possible to prevent an unbalanced load from being placed on the attachment part, leading to adverse effects upon the motion guided by the guide.

In the droplet ejection device according to the above described aspect, the liquid reservoir is preferably a pack replaceably attached to the fixed part.

Through this, the liquid reservoir according to the above described aspect of the present invention can be easily exchanged by removing a liquid reservoir packed as a pack from the fixed part and attaching a liquid reservoir to the fixed part.

In the droplet ejection device according to the above described aspect, the ejection head is preferably configured and arranged to eject, onto the substrate, the liquid droplets of a liquid that is curable by active light.

Through this, it is possible to perform swift, accurate printing that places little strain upon the environment by irradiating droplets ejected with high accuracy onto a substrate with active light.

A printing device according to another aspect of the present invention has the droplet ejecting device described above.

Thus, using the printing device according to the above described aspect of the present invention, it is possible to minimize reductions in droplet ejection accuracy and perform highly accurate printing.

In the printing device according to the above described aspect, the ejection head is preferably configured and arranged to eject the liquid droplets onto a semiconductor device provided on the substrate.

Through this, the above described aspect of the present invention makes it possible to form and print with high accuracy a printed layer displaying attribute information of the semiconductor device.

The terms "predetermined direction" and "relative movement direction" as used in these specifications comprehend deviations thereto arising from differences in manufacture or assembly.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of a printing method and printing device according to the present invention will be described below with reference to FIGS. 1 through 8.

The embodiment described below merely illustrates one aspect of the present invention; the present invention is not limited thereto, and various modifications within the technical scope of the invention may be made as desired. In the below drawings, the scale and measurements of the various structures are different from those used in actuality in order to aid understanding of the various configurations thereof.

An embodiment of a representative printing device according to the present invention and a printing method using this printing device to print by ejecting droplets will be described below with reference to FIGS. 1 through 8.

Semiconductor Substrate

First, a semiconductor substrate will be described as an example of an object of drawing/printing using a printing device.

Figure 1A:
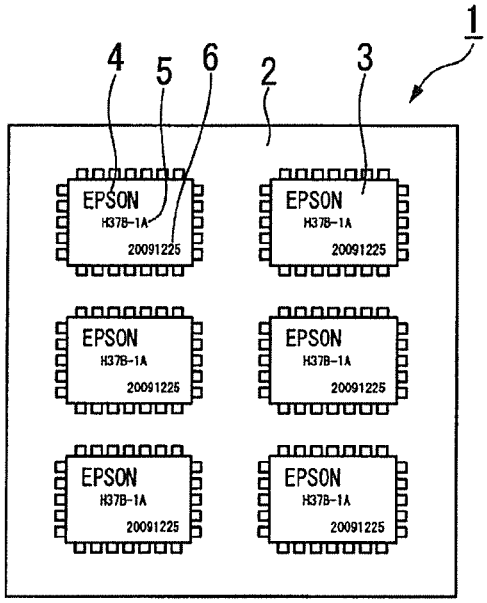
FIG. 1A is a schematic overhead view of a semiconductor substrate.

FIG. 1A is a schematic overhead view of a semiconductor substrate. As illustrated in FIG. 1A, the semiconductor substrate 1 forming the substrate has a substrate 2 and a semiconductor device 3. The substrate 2 need only be heat resistant and capable of allowing the semiconductor device 3 to be mounted thereupon, and a glass epoxy substrate, paper phenolic substrate, paper epoxy substrate, or the like can be used as the substrate 2. The semiconductor device 3, which acts as a recording medium, can be a package substrate material or a semiconductor substrate material.

A semiconductor device 3 is mounted upon the substrate 2. Markings such as a company logo 4, model code 5, manufacturing number 6, and the like are present upon the semiconductor device 3 as printed or otherwise delineated patterns. These markings are printed by a printing device described below.

Printing Device

Figure 1B:
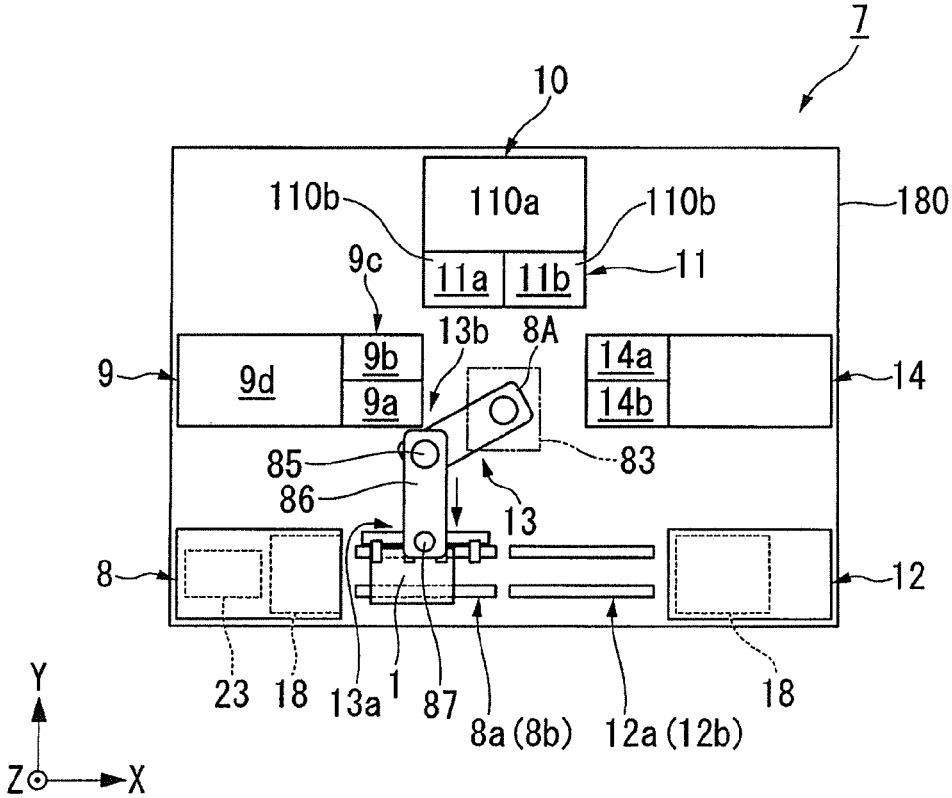
FIG. 1B is a schematic overhead view of a droplet ejecting device.

FIG. 1B is a schematic overhead view of a printing device.

As shown in FIG. 1B, the printing device 7 is constituted by a feeding part 8, preprocessing part 9, an application part (printing part, droplet ejecting device) 10, a cooling part 11, a storage part 12, a transporter part 13, a post-processing part 14, and a controller part (not shown). The direction in which the feeding part 8 and storage part 12 are aligned, and the direction in which the preprocessing part 9, cooling part 11, and post-processing part 14 are aligned, will be referred to as the "X direction". The direction perpendicular to the X direction will be referred to as the "Y direction"; the application part 10, cooling part 11, and transporter part 13 are aligned in the Y direction. The vertical direction will be referred to as the "Z direction".

The feeding part 8 has a container containing a plurality of semiconductor substrates 1. The feeding part 8 has an intermediate position 8*a*, and the semiconductor substrates 1 are supplied from the container to the intermediate position 8*a*. The intermediate position 8*a* is provided with a pair of rails 8*b* extending in the X direction disposed at roughly the same height as the semiconductor substrates 1 dispensed from the container.

The preprocessing part 9 has a function of heating and modifying the surface of the semiconductor device 3. The preprocessing part 9 regulates the spreading of the droplets ejected onto the semiconductor device 3 and the adhesiveness of the printed markings. The preprocessing part 9 has a first intermediate position 9*a* and a second intermediate position 9*b*, and takes in an unprocessed semiconductor substrate 1 from the first intermediate position 9*a* or the second intermediate position 9*b* and modifies the surface thereof. Afterward, the preprocessing part 9 transfers the processed semiconductor substrate 1 to the first intermediate position 9*a* or the second intermediate position 9*b*, and rests the semiconductor substrate 1 there. The first intermediate position 9*a* and second intermediate position 9*b* together form an intermediate position 9*c*. Processing position 9*d* is the position within the preprocessing part 9 wherein the preprocessing is performed.

The cooling part 11 is disposed at an intermediate position of the application part 10, and has the function of cooling the semiconductor substrate 1 after the same has been heated and surface-modified by the preprocessing part 9. The cooling part 11 has processing positions 11*a* and 11*b* that each retain and cool the semiconductor substrate 1. The processing positions 11*a* and 11*b* are referred to collectively as processing position 11*c*.

The application part 10 has the function of ejecting droplets onto the semiconductor device 3 so as to mark out (print) a marking, and solidifying or curing the delineated marking. The application part 10 transfers the unprinted semiconductor substrate 1 from the intermediate position constituted by the cooling part 11 and performs marking and curing. Afterward, the application part 10 transfers the printed semiconductor substrate 1 to the cooling part 11 and rests the semiconductor substrate 1 there.

The post-processing part 14 performs post-processing by reheating the semiconductor substrate 1 positioned on the cooling part 11 after marking has been performed by the application part 10. The post-processing part 14 has a first intermediate position 14*a* and a second intermediate position 14*b*. The first intermediate position 14*a* and second intermediate position 14*b* collectively form an intermediate position 14*c*.

The storage part 12 has a container capable of containing a plurality of semiconductor substrates 1. The storage part 12 has an intermediate position 12*a*, and a semiconductor substrate 1 is transferred from the intermediate position 12*a* into the container. The intermediate position 12*a* is provided with a pair of rails 12*b* extending in the X direction disposed at roughly the same height as the container containing the semiconductor substrates 1. An operator transports the container containing the semiconductor substrates 1 out of the printing device 7.

A transporter part 13 is disposed in a central position of the printing device 7. The transporter part 13 has a scalar robot equipped with two arms 13*b*. A gripper 13*a* that grips the semiconductor substrate 1 in a cantilevered manner and supports it from its reverse side (undersurface) is provided on a tip of the arm 13*b*. The intermediate positions 8*a*, 9*c*, 11, 14*c*, and 12*a* are positioned within the range of movement of the gripper 13*a*. Thus, the gripper 13*a* is capable of transporting a semiconductor substrate 1 between the intermediate positions 8*a*, 9*c*, 11, 14*c*, and 12*a*. The controller part is a device for controlling the overall operation of the printing device 7, and supervises the operating status of each part of the printing device 7. The controller part also issues a command signal to the transporter part 13 to transport the semiconductor substrate 1. Thus, the semiconductor substrate 1 passes through each part in turn and is marked.

Below follows a description of the various parts of the printing device.

Feeding Part

Figure 2A:
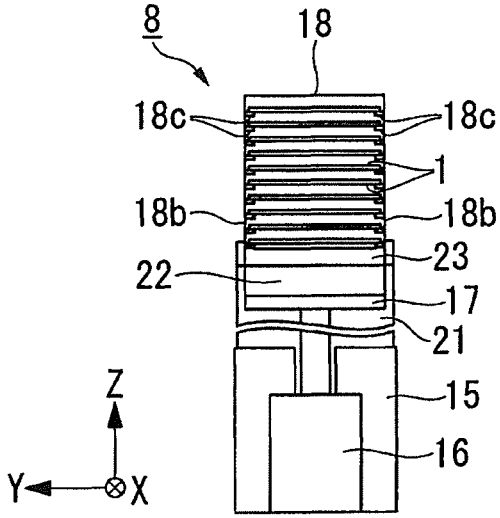
FIGS. 2A to 2C are schematic illustrations of a feeding part.
Figure 2B:
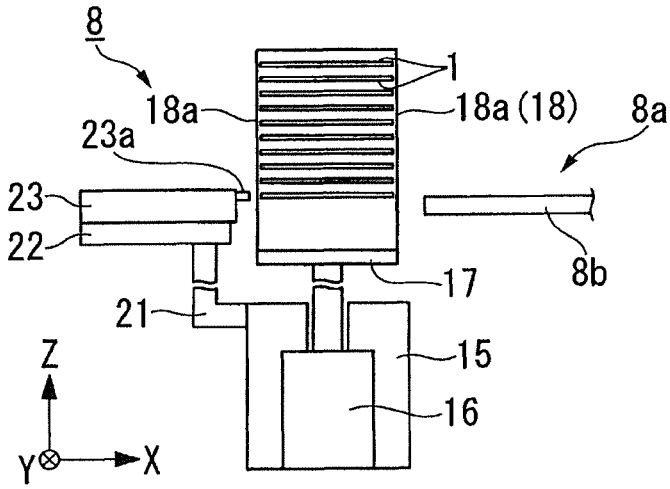
Figure 2C:
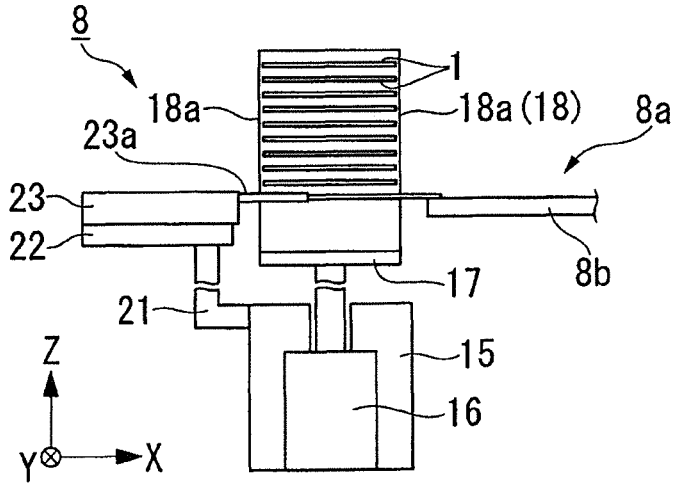

FIG. 2A is a schematic front view of a feeding part, and FIGS. 2B and 2C are schematic side views of a feeding part. As shown in FIGS. 2A and 2B, the feeding part 8 has a base 15. A lift device 16 is provided within the base 15. The lift device 16 has a direct action mechanism that operates in the Z direction. Mechanisms such as a ball screw/rotary motor combination, a hydraulic cylinder/oil pump combination, or the like may be used as the direct action mechanism. This embodiment employs a mechanism formed from, for example, a ball screw and a stepper motor. A lift platform 17 connected to the lift device 16 is provided on an upper side of the base 15. The lift platform 17 is configured so as to be able to ascend and descend only a predetermined distance by the lift device 16.

A cuboidal container 18 is provided above the lift platform 17, inside of which are contained a plurality of semiconductor substrates 1. An opening 18*a* is formed on both surfaces of the container 18 in the X direction, through which the semiconductor substrates 1 may enter and exit. Convex rails 18*c* are formed on the interiors of two side surfaces 18*b* on both sides of the container 18 in the Y direction, and the rails 18*c* extend in the X direction. The rails 18*c* are arrayed in a plurality of equidistant intervals in the Z direction. The semiconductor substrates 1 are inserted along the rails 18*c* in the X direction or the negative X direction and are stored arranged in the Z direction.

An ejector 23 is provided on a side of the base 15 in the X direction with a supporting member 21 and support platform 22 disposed therebetween. An ejector pin 23*a*, provided on the ejector 23 is thrust outward in the X direction by a direct action mechanism similar to that of the lift device 16 so as to push a semiconductor substrate 1 out toward the rails 8*b*. As such, the ejector pin 23*a* is disposed at roughly the same height as the rails 8*b*.

As illustrated in FIG. 2C, the ejector pin 23*a* of the ejector 23 projects in the positive X direction so that a semiconductor substrate 1 positioned slightly higher along the positive Z direction than the rails 18*c* is ejected from the container 18, moving onto and being supported by the rails 8*b*.

After the semiconductor substrate 1 has moved onto the rails 8*b*, the ejector pin 23*a* returns to a standby position as shown in FIG. 2B. Next, the lift device 16 lowers the container 18 so that the next semiconductor substrate 1 to be processed arrives at a height level with the ejector pin 23*a*. After this, the ejector pin 23*a* projects outward as described above to move the semiconductor substrate 1 onto the rails 8*b*.

Thus, the feeding part 8 moves the semiconductor substrates 1 in order from the container 18 onto the rails 8*b*. After all the semiconductor substrates 1 within the container 18 have been moved onto the rails 8*b*, an operator replaces the empty container 18 with another container 18 containing semiconductor substrates 1. Thus, semiconductor substrates 1 can be fed into the feeding part 8.

Preprocessing Part

The preprocessing (pretreatment) part 9 performs preprocessing at processing position 9*d* upon the semiconductor substrates 1 conveyed to the intermediate positions 9*a* and 9*b*. Examples of such preprocessing include irradiation of the heated substrate with active light generated by a low-pressure mercury vapor lamp, hydrogen burner, excimer laser, plasma discharger, or the like. Using a mercury vapor lamp enables the hydrophobicity of the surface of the semiconductor substrate 1 to be modified by irradiating the semiconductor substrate 1 with ultraviolet light. Using a hydrogen burner enables the surface to be roughened by partially reducing the oxidized surface of the semiconductor substrate 1. Using an excimer laser enables the surface to be roughened by partially melting and solidifying the surface of the semiconductor substrate 1. Using a plasma or corona discharger enables surface roughening by mechanically abrading the surface of the semiconductor substrate 1. In this embodiment, a mercury vapor lamp is employed.

After preprocessing is complete, the preprocessing part 9 transfers the semiconductor substrate 1 to the intermediate position 9*c*. Next, the transporter part 13 removes the semiconductor substrate 1 from the intermediate position 9*c*.

Cooling Part

The cooling part 11 is provided with the processing positions 11*a* and 11*b*, and has cooling platforms 110*a* and 110*b* that are heat sinks or the like, the upper surfaces of which hold the semiconductor substrate 1 using suction.

The processing positions 11*a* and 11*b* (cooling platforms 110*a* and 110*b*) are positioned within the range of motion of the gripper 13*a*, and the cooling platforms 110*a* and 110*b* are exposed at the processing positions 11*a* and 11*b*. Thus, the transporter part 13 is capable of easily placing the semiconductor substrates 1 on the cooling platforms 110*a* and 110*b*. After the semiconductor substrate 1 has been cooled, the semiconductor substrate 1 is left resting on cooling platform 110*a* at processing position 11*a* or on cooling platform 110*a* at processing position 11*b*. Thus, the gripper 13*a* of the transporter part 13 is capable of easily gripping and transporting the semiconductor substrate 1.

Application Part

Next, the application part 10, which ejects droplets onto a semiconductor substrate 1 to form markings, will be described with reference to FIGS. 3 through 5. A variety of devices for ejecting droplets are available, but a device using an inkjet method is preferred. An inkjet method allows microscopic droplets to be formed, making it well suited to fine processing.

Figure 3:
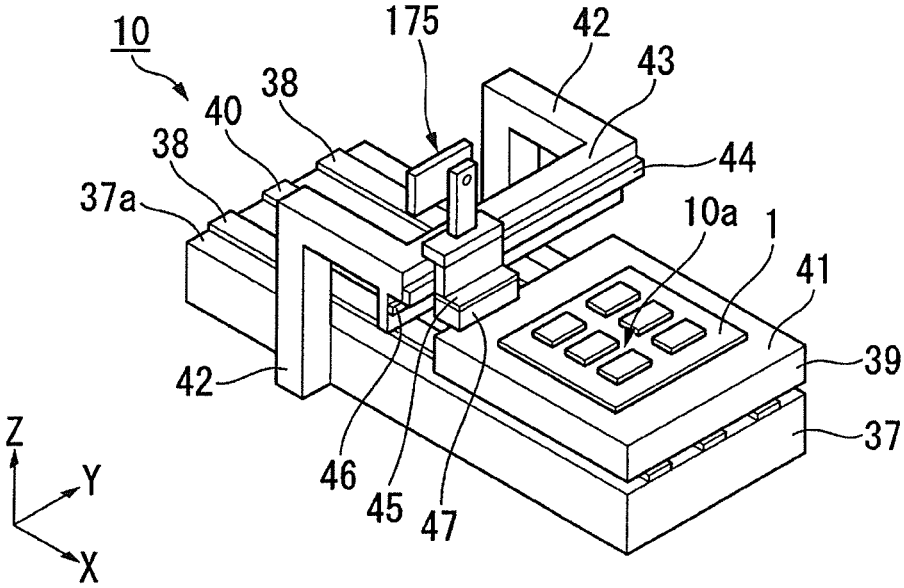
FIG. 3 is an outline perspective view of the configuration of an application part.

FIG. 3 is an outline perspective view of the configuration of an application part. Droplets are ejected onto the semiconductor substrate 1 by the application part 10. As illustrated in FIG. 3, the application part 10 has a cuboidal base 37. The direction in which the droplet ejection head and the ejected material move relative to each other when droplets are ejected is the primary scanning direction. The direction perpendicular to the primary scanning direction is the secondary scanning direction. The secondary scanning direction is the direction in which the droplet ejection head and the ejected material move relative to each other when shifting lines. In this embodiment, the Y direction (second direction) is the primary scanning direction, and the X direction (first direction) is the secondary scanning direction.

A pair of guide rails 38 extending in the X direction is provided along the entire length of the X direction on an upper surface 37*a* of the base 37. A stage 39 having a direct action mechanism not shown in the drawings is attached to an upper side of the base 37 corresponding to the pair of guide rails 38. A linear motor, screw-type direct action mechanism, or the like may be used as the direct action mechanism of the stage 39. In this embodiment, for example, a linear motor is employed. The stage 39 is configured to travel and return at a predetermined speed along the X direction. The repetition of traveling and returning is referred to as scanning. A secondary scanning position detector 40 is further disposed on the upper surface 37*a* of the base 37 in parallel with the guide rails 38; this secondary scanning position detector 40 detects the position of the stage 39.

A rest surface 41 is formed on an upper surface of the stage 39, and the rest surface 41 is provided with a vacuum-type substrate chuck mechanism not shown in the drawings. After a semiconductor substrate 1 is placed upon the rest surface 41, the semiconductor substrate 1 is held in place on the rest surface 41 by the substrate chuck mechanism.

The position of the rest surface 41 when the stage 39 is positioned in, for example, the positive X direction is an intermediate position for a semiconductor substrate 1 loading or unloading position. The rest surface 41 is disposed so as to be exposed within the range of motion of the gripper 13*a*. Thus, the transporter part 13 is capable of easily placing a semiconductor substrate 1 on the rest surface 41. After the semiconductor substrate 1 has been coated (marking have been applied), the semiconductor substrate 1 rests upon the rest surface 41, which is an intermediate position. Thus, the gripper 13*a* of the transporter part 13 is capable of easily gripping and transporting a semiconductor substrate 1.

A pair of support platforms 42 is provided on both sides of the base 37 in the Y direction, and a guide member 43 extending in the Y direction is provided so as to bridge the pair of support platforms 42. A guide rail 44 (guide) extending in the Y direction is provided along the entirety of the X direction on the underside of the guide member 43. A carriage (moving part) 45 capable of moving along the guide rail 44 is formed in a roughly cuboidal shape. The carriage 45 has a direct action mechanism (not shown), and the direct action mechanism may be one similar to that of, for example, the stage 39. The carriage 45 scans (moves relatively) in the Y direction. A primary scanning position detector 46 that measures the position of the carriage 45 is provided between the guide member 43 and the carriage 45. A head unit 47 is provided on the lower edge of the carriage 45, and a droplet ejection head not shown in FIG. 3 is provided on the side of the head unit 47 towards the stage 39.

Figure 4B:
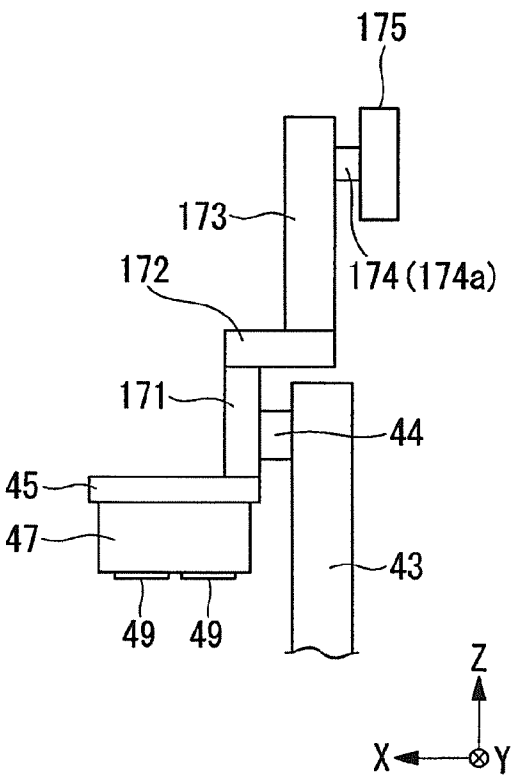
FIG. 4B is a right side view of the same.
Figure 4A:
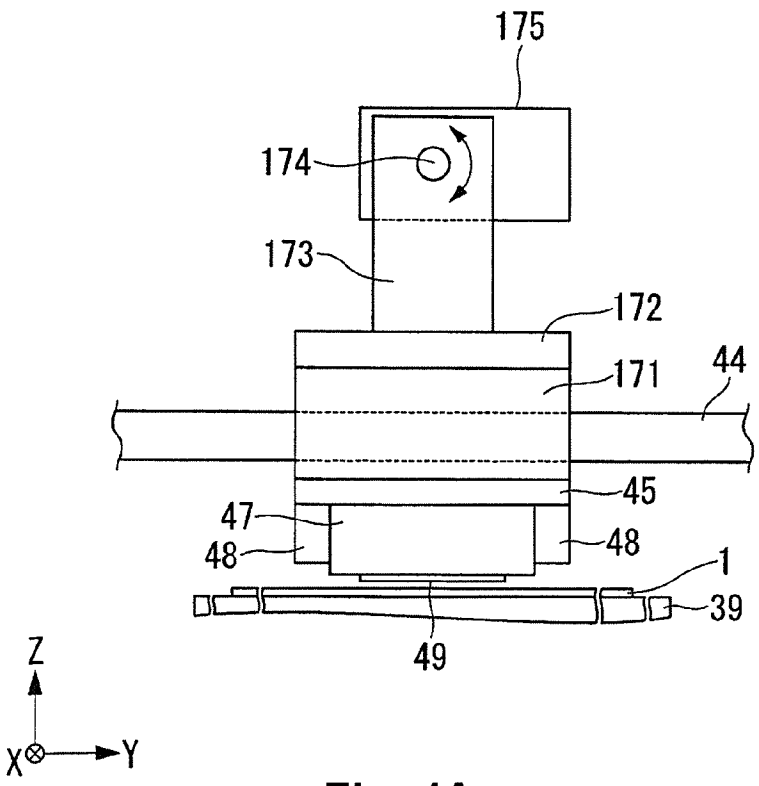
FIG. 4A is a schematic front view of the periphery of a carriage.

FIG. 4A is a schematic front view of the periphery of a carriage 45, and FIG. 4B is a right side view of the same. As shown in FIG. 4A, the head unit 47 and a pair of curing units 48 acting as irradiators are disposed on the side of the carriage 45 nearer the semiconductor substrate 1 at equal respective distances from the center of the carriage 45 with respect to the Y direction. A droplet ejection head (ejection head) 49 that ejects droplets is provided on the side of the head unit 47 nearer to the semiconductor substrate 1.

Within the curing units 48 are disposed irradiating devices that cure the ejected droplets using ultraviolet light irradiation. The curing units 48 are disposed on either side of the head unit 47 in the primary scanning direction (relative movement direction). Each irradiating device is constituted by a light-emitting unit and a heat sink. A plurality of LED (light emitting diode) elements are arrayed upon the light-emitting unit. The LED elements receive power and emit ultraviolet radiation in the form of ultraviolet light.

The carriage 45 is supported by the lower end (negative Z direction end) of a rectangular attachment plate (attachment part) 171 movably attached to the guide rail 44 parallel to the YZ plane. A positive X direction side part of a fixed plate (fixed part) 172 that is parallel to the XY plane is provided on an upper end of the attachment plate 171 separately from the carriage 45. A gap is present between a negative X direction end of the fixed plate 172 and the upper portion of the guide member 43, so that said end is capable of moving in the Y direction without contacting the guide member 43.

A support plate 173 parallel to the YZ plane and extending in the Z direction is provided in a vertical position on the negative X direction end of the fixed plate 172. A rotating drive device 174 constituted by a rotary actuator or the like is provided on the support plate 173 as a stirring device, and a pack (liquid reservoir) 175, in which liquid (functional fluid) ejected through the droplet ejection head 49 onto the semiconductor substrate 1 is stored, is replaceably attached to the rotating drive device 174. The pack 175 is formed as, for example, a pouch formed from a flexible material and is connected to the droplet ejection head 49 by a tube not shown in the drawings, and liquid within the pack 175 is supplied to the droplet ejection head 49 via the tube.

The rotating drive device 174 has a rotating shaft 174*a* that rotates under control around an axis parallel to the X axis. The rotating shaft 174*a* protrudes from the negative X direction side of the support plate 173, and the pack 175 is replaceably (attachably/detachably) attached at a position on the rotating shaft 174*a* protruding further in the negative X direction than the guide member 43. Specifically, the pack 175 is disposed on the opposite side of the guide rail 44 as the carriage 45 with respect to both the Z direction and the X direction, and is attached at a position such that it does not contact the guide member 43 in the X direction.

The head unit 47 containing the droplet ejection head 49, the carriage 45, the attachment plate 171, the fixed plate 172, the support plate 173, the rotating drive device 174, and the pack 175 all move integrally along the guide rail 44 in the Y direction.

The functional fluid contains a resin material, a photopolymerization initiator as a curing agent, and a vehicle or dispersion medium as primary components. A color agent such as a pigment or dye, a functional component such as a hydrophilic or hydrophobic resurfacing agent, or the like may be added to the primary components to obtain a functional fluid with unique functionality. In this embodiment, for example, a white pigment is added. The resin component of the functional fluid is for forming a resin layer. There is no particular limitation upon the resin component as long as it is liquid at room temperature and can be polymerized. Also, a resin component with low viscosity is preferable, as is one that is an oligomer. A monomer is especially preferable. The photopolymerization initiator acts upon a cross-linkable group of the polymer to effect a crosslinking reaction; an example of one such photopolymerization initiator is benzyl dimethyl ketal or the like. The vehicle or dispersion medium regulates the viscosity of the resin component. By adjusting the functional fluid to a viscosity such that it is easily ejected from the droplet ejection head, it is possible for the droplet ejection head to stably eject functional fluid.

Figure 5A:
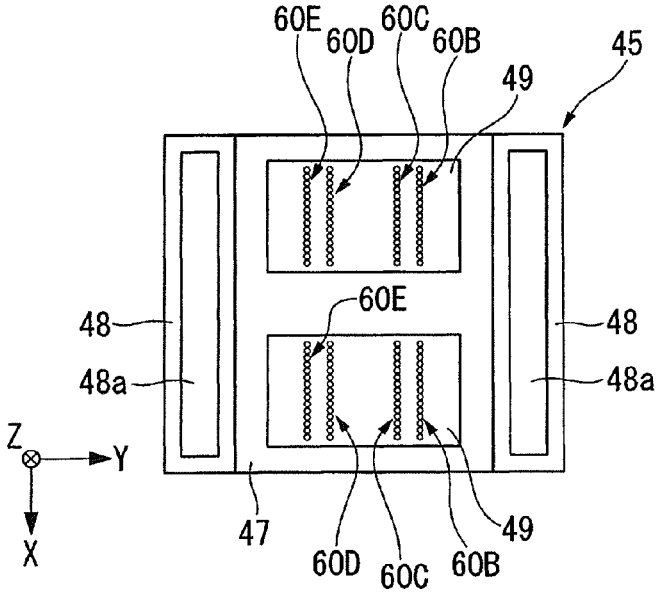
FIG. 5A is a schematic overhead view of a head unit.

FIG. 5A is a schematic overhead view of a head unit. As illustrated in FIG. 5A, two droplet ejection heads 49 are disposed with an interval therebetween in the secondary scanning direction (X direction) on the head unit 47, and a nozzle plate 51 (see FIG. 5B) is disposed on the surface of each droplet ejection head 49. A plurality of nozzles 52 are disposed in rows on each nozzle plate 51. In this embodiment, nozzle rows 60*b* through 60*e* of fifteen nozzles 52 are disposed arranged along the secondary scanning direction with gaps therebetween in the Y direction on each nozzle plate 51. The nozzle rows 60*b* through 60*e* disposed on the two droplet ejection heads 49 are disposed along straight lines in the X direction. Nozzle rows 60*b* and 60*e* are disposed at equal distances from the center of the carriage 45 with respect to the Y direction. Likewise, nozzle rows 60*c* and 60*d* are disposed at equal distances from the center of the carriage 45 with respect to the Y direction. Thus, the distance between the curing units 48 and nozzle row 60*b* in the positive Y direction is equal to the distance between the curing units 48 and nozzle row 60*e* in the negative Y direction. Likewise, the distance between the curing units 48 and nozzle row 60*c* in the positive Y direction is equal to the distance between the curing units 48 and nozzle row 60*d* in the negative Y direction.

An irradiation aperture 48*a* is formed on the underside of the curing unit 48. The irradiation aperture 48*a* has an irradiation range of a length equal to or greater than the sum of the length of the ejection heads 49, 49 in the Y direction and the distance between the ejection heads 49, 49. The ultraviolet light emitted by the irradiating device radiates through the irradiation aperture 48*a* onto the semiconductor substrate 1.

Figure 5B:
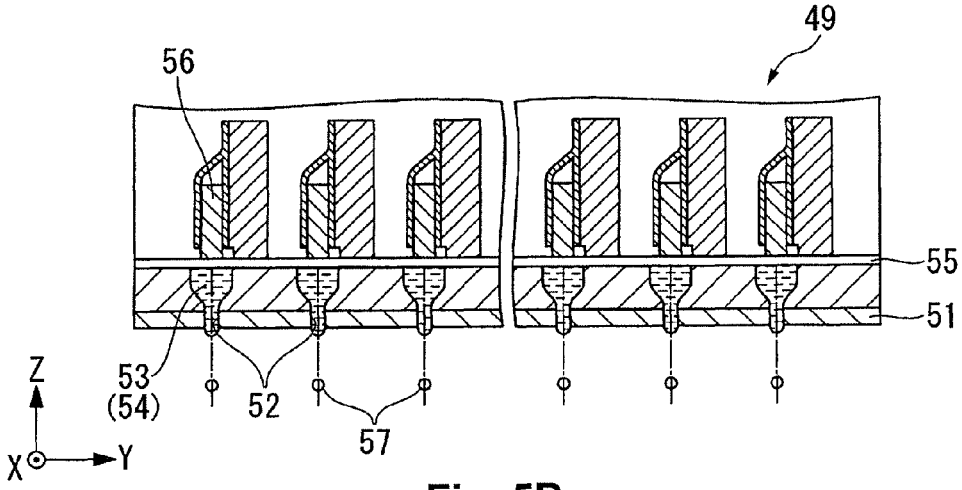
FIG. 5B is a schematic cross-sectional view of primary components for illustrating the structure of a droplet ejection head.

FIG. 5B is a schematic cross-section of the primary parts for describing the construction of a droplet ejection head. As shown in FIG. 5B, the droplet ejection head 49 has a nozzle plate 51, and a nozzle 52 is formed on the nozzle plate 51. A cavity 53 communicating with the nozzle 52 is formed on the upper side of the nozzle plate 51 in a position corresponding to the nozzle 52. Functional fluid (liquid) 54 is supplied to the cavity 53 of the droplet ejection head 49.

A vibrational plate 55 that vibrates up and down, and expands and contracts the volume of the cavity 53, is provided on an upper side of the cavity 53. A piezoelectric element 56 that expands and contracts vertically and vibrates the vibrational plate 55 is disposed on an upper side of the vibrational plate 55 in a position corresponding to the cavity 53. The piezoelectric element 56 expands and contracts vertically, placing pressure on the vibrational plate 55 and causing it to vibrate, and the vibrational plate 55 expands and contracts the volume of the cavity 53, placing pressure upon the cavity 53. This causes the pressure within the cavity 53 to vary, and the functional fluid 54 within the cavity 53 to be ejected through the nozzle 52.

When the droplet ejection head 49 receives a nozzle drive signal for driving the piezoelectric element 56, the piezoelectric element 56 expands, and the vibrational plate 55 decreases the volume of the cavity 53. As a result, an amount of the functional fluid 54 equal to the amount of volume decrease is ejected from the nozzle 52 of the droplet ejection head 49 in the form of droplets 57. In this embodiment, the nozzle 52 that ejects the droplets is selected for each nozzle row by the control of the controller part. After the functional fluid 54 has been applied thereto, the semiconductor substrate 1 is irradiated with ultraviolet light from the irradiation aperture 48*a*, so the functional fluid 54, which contains a curing agent, solidifies or cures.

Storage Part

Figure 6A:
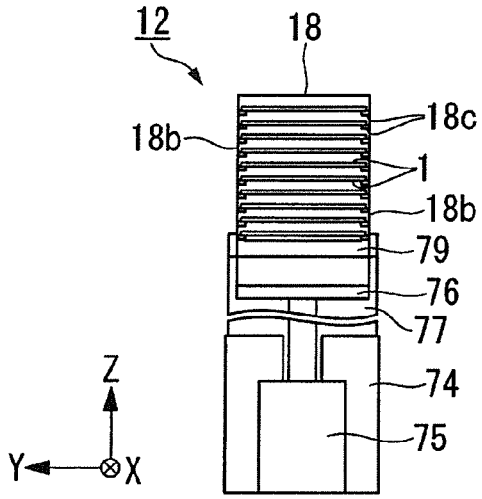
FIGS. 6A to 6C are schematic illustrations of a storage part.
Figure 6B:
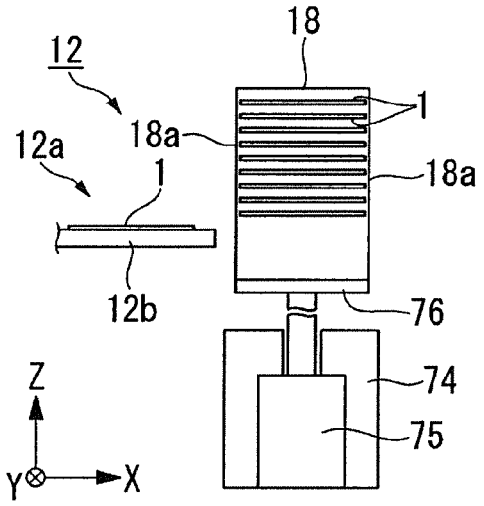
Figure 6C:
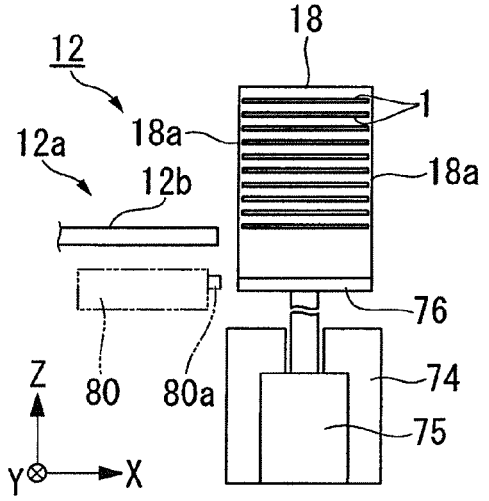

FIG. 6A is a schematic front view of a storage part, and FIGS. 6B and 6C are schematic side views of a storage part. As shown in FIGS. 6A and 6B, the storage part 12 has a base 74. A lift device 75 is provided within the base 74. A device similar to that used for the lift device 16 provided in the feeding part 8 can be used for the lift device 75. A lift platform 76 connected to the lift device 75 is provided on an upper side of the base 74. The lift platform 76 is raised and lowered by the lift device 75. A cuboidal container 18 is provided above the lift platform 76, inside of which is contained a semiconductor substrate 1. The container 18 is the same container 18 as provided in the feeding part 8.

A semiconductor substrate 1 placed on the intermediate position formed by the rails 12*b* by the transporter part 13 is carried from the rails 12*b* to the container 18 by the transporter part 13. Alternatively, a configuration such as that shown in FIG. 6C may be adopted wherein, for example, an ejector 80 having the same configuration as the ejector 23 above is provided underneath the rails 12*b* and positioned between the two rails 12*b*, 12*b* in the Y direction and is capable, by means of a lift device not shown in the drawings, of rising to a position level with the semiconductor substrate 1 after the semiconductor substrate 1 has been transported by the transporter part 13 from the rails 12*b* halfway to the container 18; and, when the transporter part 13 places the semiconductor substrate 1 on the rails 12*b*, the ejector 80 waits underneath the rails 12*b*, and, after the transporter part 13 has withdrawn from the rails 12*b*, the ejector 80 is raised to face the side of the semiconductor substrate 1, the semiconductor substrate 1 is moved into the container 18 by an ejector pin 23*a* that projects in the positive X direction.

After a predetermined number of semiconductor substrates 1 have been stored within the container 18 through repeatedly insertion of semiconductor substrates 1 into the container 18 and moving in the Z direction of the container 18 using the lift device 75 as described above, an operator replaces the container 18 filled with semiconductor substrates 1 with an empty container 18. Thus, an operator is able to collectively transport a plurality of semiconductor substrates 1 to the next process.

Transporter Part

Next, a transporter part 13 for transporting the semiconductor substrate 1 will be described with reference to FIGS. 1 and 7.

The transporter part 13 has a support 83 provided on a ceiling of the device interior, with a rotation mechanism formed from a motor, an angle detector, a decelerator, and the like provided within the support 83. An output shaft of the motor is connected to the decelerator, and an output shaft of the decelerator is connected to a first arm 84 disposed underneath the support 83. The angle detector is coupled to the output shaft of the motor, and the angle detector detects the angle of rotation of the output shaft of the motor. Thus, the rotation mechanism is capable of detecting the angle of rotation of the first arm 84, and rotating to a desired angle.

A rotation mechanism 85 is provided on the first arm 84 on an end opposite to the support 83. The rotation mechanism 85 is constituted by a motor, an angle detector, a decelerator, and the like, and has a function similar to that of the rotation mechanism provided in the support 83. An output shaft of the rotation mechanism 85 is connected to a second arm 86. Thus, the rotation mechanism 85 is capable of detecting the angle of rotation of the second arm 86, and rotating to a desired angle.

A lift device 87 is provided on the second arm 86 on an end opposite to the rotation mechanism 85. The lift device 87 has a direct action mechanism, and is capable of extending and retracting by driving the direct action mechanism. A mechanism similar to that of, for example, the lift device 16 of the feeding part 8 may be used for the direct action mechanism.

Figure 7B:
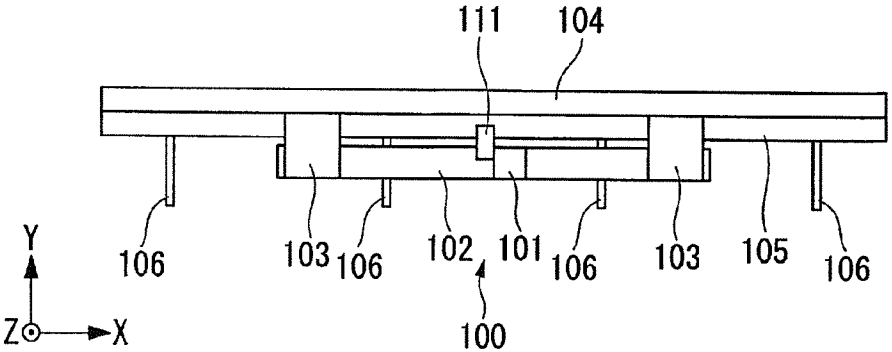
FIGS. 7A to 7C are schematic illustrations of the configuration of a transporter part.
Figure 7A:
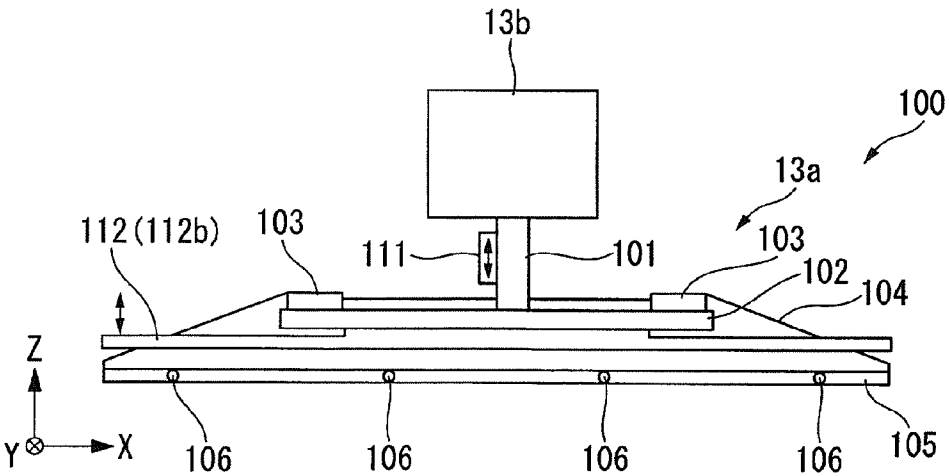
Figure 7C:
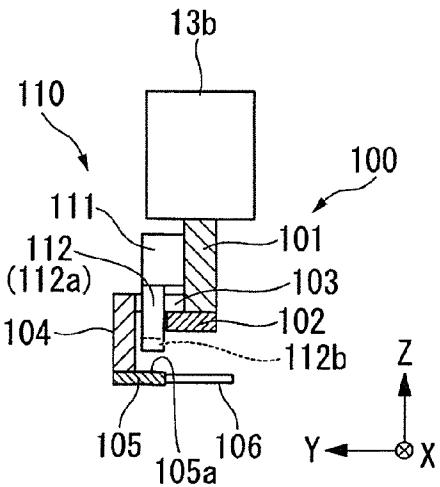

FIG. 7A is a frontal view of a gripper 13*a* disposed on a negative Z direction side of an arm 13*b*, FIG. 7B is an overhead view of the same (omitting the arm 13*b*), and FIG. 7C is a left side view of the same.

As the gripper 13*a* is provided so as to be rotatable in the θZ direction (the direction around the Z axis) with respect to the arm 13*b*, and its position in the XY plane varies, for convenience of description, one direction parallel with the XY plane will be referred to as the X direction, and a direction parallel with the XY plane and perpendicular to the X direction will be referred to as the Y direction (Z direction same for both).

The gripper 13*a* has a fixed part 100 rotatable in the θZ direction with respect to the arm 13*b* and used in a fixed state when a semiconductor substrate 1 is being gripped, and a moving part 110 freely movable in the Z direction with respect to the fixed part 100.

The primary elements constituting the fixed part 100 are a Z axis member 101, a suspension member 102, a linking member 103, a linkage plate 104, a grip plate 105, and a fork 106. The Z axis member 101 extends in the Z direction and is rotatable about the Z axis around the arm 13*b*. The suspension member 102 is formed as a strip extending in the X direction, and is fixed to a lower end of the Z axis member 101 in a central position along the X direction. The linkage plate 104 is disposed parallel to the suspension member 102 so as to leave a gap therebetween, and is linked with the suspension member 102 on both ends in the X direction by the linking member 103. The grip plate 105 is formed as a plate extending in the X direction, and, as shown in FIG. 7C, a positive Z direction surface thereof is fixed to the lower side of the linkage plate 104 on an edge thereof in the positive Y direction. Of the positive Z direction surface of the grip plate 105, a negative Y direction edge thereof acts as a gripping surface 105*a* when a semiconductor substrate 1 is being gripped.

The fork 106 supports from underneath the underside (negative Z direction surface) of the semiconductor substrate 1 gripped by the gripping surface 105*a*, and a plurality thereof (in this embodiment, four) extending in the Y direction from a negative Y direction side surface of the grip plate 105 are provided at intervals in the X direction. Even when the length of the semiconductor substrate 1 varies depending according to model, the spacing and number of the forks 106 are such that the substrate is supported at one location along the lengthwise direction, preferably at two locations.

The primary elements constituting the moving part 110 are an ascending/descending part 111 and a grip plate 112. The ascending/descending part 111 is constituted by an air cylinder mechanism or the like, and ascends and descends along the Z axis member 101. The grip plate 112 is capable of ascending and descending integrally with the ascending/descending part 111, is shorter than the gap in the x direction between the two linking members 103, 103, and has a width less than the gap between the suspension member 102 and the linkage plate 104; and is formed from an inserted part 112*a* inserted movably in the Z direction in the gap between the two linking members 103 and the gap between the suspension member 102 and the linkage plate 104, and a grip plate 112*b* formed integrally therewith positioned below the inserted part 112*a* and extending in the X direction for roughly the same length as the grip plate 105 underneath the suspension member 102.

The grip plate 112 constituted by the inserted part 112*a* and the grip plate 112*b* move integrally in the Z direction in response to the vertical motion of the ascending/descending part 111. When lowered, the grip plate 112 is capable, along with the grip plate 115, of gripping an end of the semiconductor substrate 1 therebetween; and when raised, the grip plate 112 releases the grip on the semiconductor substrate 1 by separating from the grip plate 115.

By inputting the data output by the detector provided on the transporter part 13 and detecting the position and disposition of the gripper 13*a*, and driving the rotation mechanism 85 so as to move the gripper 13*a* to a specific position, it is possible to transport the semiconductor substrate 1 being gripped by the gripper 13*a* to a specific processing part.

Printing Method

Figure 8:
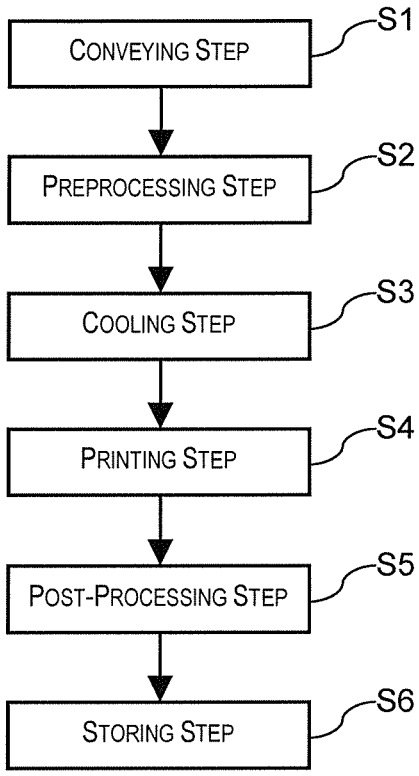
FIG. 8 is a flow chart illustrating a printing method.

Next, a printing method utilizing the above printing device 7 will be described with reference to FIG. 8. FIG. 8 is a flow chart illustrating a printing method.

As illustrated in the flow chart of FIG. 8, the printing method is primarily composed of a conveying step S1 of taking in a semiconductor substrate 1 from a container 18, a preprocessing step S2 of performing preprocessing on the surface of the semiconductor substrate 1 that has been taken in, a cooling step S3 of cooling the semiconductor substrate 1 after being heated during the preceding preprocessing step S2, a printing step S4 of printing various markings on the cooled semiconductor substrate 1, a post-processing step S5 of performing post-processing on the semiconductor substrate 1 printed with the markings, and a storing step S6 of storing the semiconductor substrate 1 after post-processing has been performed within a container 18.

Of the above steps, the printing step S4 is a characteristic of the present invention, and will thus be described below.

The semiconductor substrate 1 upon which preprocessing was performed during the preprocessing step and upon which cooling was performed during the cooling step S3 is transported by the transporter part 13 to a stage 39 located at an intermediate position 10*a* of the application part 10. During printing step S4, the application part 10 actuates the chuck mechanism to hold the semiconductor substrate 1 resting on the stage 39 in place upon the stage 39. Within the application part 10, the rotating shaft 174*a* of the rotating drive device 174 is driven at, for instance, a predetermined interval of time, and the pack 175 is rotated or rocked within a range of, for example, 90° until the controller part initiates coating (printing). This stirs the liquid within the pack 175, enabling adverse effects upon ejectability due to settling to be avoided. The range and frequency of the rotation or rocking of the pack 175 may be selected as suits the liquid within the pack 175.

In the application part 10, droplets 57 are ejected from a nozzle 52 in the nozzle rows formed on each droplet ejection head 49 onto the semiconductor device 3 while the carriage 45 is made via the attachment plate 171 to scan (engage in relative movement) in, for example, the positive Y direction as an initial direction over the stage 39. During the return scan, droplets 57 are ejected from a nozzle 52 in the nozzle rows formed on each droplet ejection head 49 while the carriage 45 scans (engage in relative movement) in the negative Y direction over the stage 39 at the same speed as during the initial scan. After ejecting the droplets 57, the droplet ejection heads 49 are supplied (refilled) with liquid from the pack 175 via the tub.

When the carriage 45 is scanning, the attachment plate 171, fixed plate 172, support plate 173, rotating drive device 174, and pack 175 move integrally along the guide rail 44 along with the carriage 45 and the head unit 47 containing the droplet ejection head 49. Because the fixed plate 172, support plate 173, rotating drive device 174, and pack 175 are attached to the attachment plate 171 separately from the carriage 45, a reduction in printing accuracy when the droplets are ejected from the droplet ejection heads 49 caused by the carriage 45 bending from a large load being placed upon it, as would happen if the above parts were attached to the carriage 45, can be avoided.

Thus, markings such as a company logo 4, model code 5, manufacturing number 6, are formed on the surface of the semiconductor device 3 due to droplet ejection being performed. During the initial scan, the markings are irradiated with ultraviolet light by the curing unit 48 provided on the negative Y direction side of the carriage 45, which is positioned towards the rear with regards to the scanning direction; and during the return scan, the marking are irradiated with ultraviolet light by the curing unit 48 provided on the positive Y direction side of the carriage 45, which is positioned towards the rear with regards to the scanning direction. Because the functional fluid 54 forming the markings contains a photopolymerization initiator, which initiates polymerization under ultraviolet light, this causes the surface of the markings to instantly solidify or cure.

When printing of the semiconductor substrate 1 is complete, the application part 10 moves the stage 39 upon which the semiconductor substrate 1 to an unloading position. This enables the transporter part 13 to more easily grasp the semiconductor substrate 1. Then, the application part 10 stops actuating the chuck mechanism, releasing the grip on the semiconductor substrate 1. When the printing process is complete, the controller part stirs the liquid within the pack 175 by rotating or rocking the pack 175 at a predetermined interval until the controller part again drives the rotating drive device 174 and the next printing process begins.

Then, after post-processing is performed in the post-processing step S5, the semiconductor substrate 1 is transported by the transporter part 13 to the storage part 12 and stored within the container 18 in the storing step S6.

As described above, because the pack 175 is attached separately from the carriage 45 in this embodiment, reductions in the droplet ejection accuracy of the droplet ejection heads 49 due to a deformation arising in the carriage 45 because of a large load being placed thereupon can be minimized. For this reason, it is possible in this embodiment to form a marking with a predetermined printing accuracy, and to manufacture a semiconductor substrate 1 upon which a marking is formed with high display quality.

In particular, because the carriage 45 and pack 175 are disposed on opposite sides of the guide rail 44 with respect to both the Z direction and the X direction in this embodiment, adverse effects during movement along the guide rail 44 caused by an unbalanced load being place thereupon, as would happen if the carriage 45 and pack 175 were disposed on the same side, can be prevented.

Also, because the pack 175 is stirred using the rotating drive device 174 in this embodiment, defects arising from liquid settling, such as coagulation of the liquid, can be prevented before they occur. Moreover, because the rotating drive device 174 is mounted on the attachment plate 171 in this embodiment, the distance between the rotating drive device 174 and the pack 175 can be reduced, allowing the liquid within the pack 175 to be stirred swiftly and easily. Moreover, because the pack 175 is rotated or rocked around an axis extending in a horizontal direction in this embodiment, the liquid within the pack 175 is moved up and down, enabling effective agitation.

A favorable mode of embodying the present invention was described above with reference to the attached drawings, but it goes without saying that the present invention is not limited to this example. The shapes, assembly, and so forth of the various component parts described in the above example are but one example, and various modifications within the scope of the present invention can be made as design requirements dictate.

For example, a pack 175 formed from a flexible material was given as an example of liquid reservoir in the above embodiment, but the liquid reservoir is not limited to this, and may, for example, also be a cartridge formed from a synthetic resin.

Likewise, in the configuration of the above embodiment, the pack 175 was stirred by means of rotational movement, but such agitation is not limited to this, and a configuration utilizing reciprocating or revolving movement may be adopted as well.

Again, while a device constituted by a rotary actuator or the like was given in the above embodiment as an example of a stirring device, a configuration wherein a user manually rotates and stirs the pack 175 attached to the rotating shaft 174*a* may also be adopted.

In configuration of the above embodiment, the attachment plate 171, fixed plate 172, and support plate 173 were each formed as separate parts, but the invention is not limited to this, and a configuration wherein two or more of these parts are manufactured as a single piece may also be adopted.

In the configuration of the above embodiment, the carriage 45 and pack 175 were disposed on opposite sides of the guide rail 44 with respect to both the Z direction and the X direction, but the invention is not limited to this, and a configuration wherein the carriage 45 and pack 175 are disposed on opposite sides of the guide rail 44 with respect to only one of the Z direction and the X direction will also yield the effect of reducing an unbalanced load from being placed on the guide rail 44.

In the above embodiment, a UV-curable ink was used as the UV-curable ink, but the present invention is not limited to this, and various active light-curable inks using visible light or infra-red light to cure can be used.

Likewise, a variety of active light sources emitting visible light or another type of active light, i.e., active light irradiators, may be used.

In the above embodiment, the substrate constituted by the semiconductor substrate 1 was a substrate 2 upon which a semiconductor device 3 was mounted, but a substrate formed from a semiconductor such as silicon is also acceptable. The semiconductor device 3 constituting the recording medium can be a semiconductor device molded from resin, or can itself be a semiconductor device.

In the context of the present invention, there is no particular limit upon the "active light" so long as it is capable of imparting energy capable of generating initiating species in the ink via irradiation; and the term broadly includes alpha waves, gamma waves, X-rays, ultraviolet light, visible light, and electron beams. Of these, from considerations of curing sensitivity and ease of equipment procurement, ultraviolet light or an electron beam are preferable, and ultraviolet light is especially preferable. As such, it is preferable that the active light-curable ink be a UV-curable ink that cures upon irradiation with ultraviolet light, as in the case of this embodiment.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A droplet ejecting device comprising:

an ejection head configured and arranged to eject liquid droplets onto a substrate;

a moving body supporting the ejection head, and configured and arranged to move integrally with the ejection head with respect to the substrate;

a guide part extending in a first direction, the guide part being configured and arranged to guide a relative movement of the moving body in the first direction;

an attachment part attached to the guide part, supporting the moving body, and configured and arranged to move integrally with the moving body;

a fixed part fixed to the attachment part separately from the moving body; and a liquid reservoir provided to the fixed part, and configured and arranged to store the liquid supplied to the ejection head, the liquid reservoir being disposed on an opposite side relative to the moving body in a second direction perpendicular to the first direction and a vertical direction of the droplet ejecting device such that the guide part is disposed between the liquid reservoir and the moving body in the second direction.

2. A droplet ejecting device comprising:

an ejection head configured and arranged to eject liquid droplets onto a substrate, a moving body supporting the ejection head, and configured and arranged to move integrally with the ejection head with respect to the substrate;

a guide part configured and arranged to guide a relative movement of the moving body;

an attachment part attached to the guide part and supporting the moving body, and configured and arranged to move integrally with the moving body;

a fixed part fixed to the attachment part separately from the moving body;

a liquid reservoir provided to the fixed part, and configured and arranged to store the liquid supplied to the ejection head; and a stirring device provided on the fixed part, and configured and arranged to move and stir the liquid reservoir.

3. The droplet ejecting device according to claim 2, wherein the stirring device includes a rotating drive device configured and arranged to rotate the liquid reservoir around an axis extending in a horizontal direction.

4. The droplet ejecting device according to claim 2, wherein the liquid reservoir is disposed on an opposite side relative to the moving body in a predetermined direction with the guide part being disposed between the liquid reservoir and the moving body in the predetermined direction.

5. The droplet ejecting device according to claim 2, wherein the liquid reservoir is a pack replaceably attached to the fixed part.

6. The droplet ejecting device according to claim 2, wherein the ejection head is configured and arranged to eject, onto the substrate, the liquid droplets of a liquid that is curable by active light.

7. A printing device comprising the droplet ejecting device according to claim 1.

8. The printing device according to claim 7, wherein the ejection head is configured and arranged to eject the liquid droplets onto a semiconductor device provided on the substrate.

9. A printing device comprising the droplet ejecting device according to claim 2.

10. The printing device according to claim 9, wherein the ejection head is configured and arranged to eject the liquid droplets onto a semiconductor device provided on the substrate.

11. A printing device comprising the droplet ejecting device according to claim 3.

12. The printing device according to claim 11, wherein the ejection head is configured and arranged to eject the liquid droplets onto a semiconductor device provided on the substrate.

13. A printing device comprising the droplet ejecting device according to claim 4.

14. The printing device according to claim 13, wherein the ejection head is configured and arranged to eject the liquid droplets onto a semiconductor device provided on the substrate.

15. A printing device comprising the droplet ejecting device according to claim 5.

16. The printing device according to claim 15, wherein the ejection head is configured and arranged to eject the liquid droplets onto a semiconductor device provided on the substrate.

17. A printing device comprising the droplet ejecting device according to claim 6.

18. The printing device according to claim 17, wherein the ejection head is configured and arranged to eject the liquid droplets onto a semiconductor device provided on the substrate.

19. The printing device according to claim 1, wherein the liquid reservoir is spaced apart from the guide part in the second direction as viewed in the vertical direction.

20. The printing device according to claim 1, wherein the guide part has a guide member and a projecting portion that projects from the guide member in the second direction, the projecting portion is configured and arranged to guide a relative movement of the moving body, an attachment part is attached to the projecting portion, and the liquid reservoir is disposed on an opposite side relative to the moving body in the vertical direction, such that the projecting portion is disposed between the liquid reservoir and the moving body in the vertical direction, and the liquid reservoir is spaced apart from the projecting portion in the vertical as viewed in the second direction.

* * * * *